US006079602A

United States Patent [19]

Howell

[11] Patent Number: 6,079,602

[45] Date of Patent: Jun. 27, 2000

[54] BACKPACK QUICK RELEASE SYSTEM

[75] Inventor: Clarence F. Howell, Bridgton, Me.

[73] Assignee: Down East, Inc., Bridgton, Me.

[21] Appl. No.: 09/133,798

[22] Filed: Aug. 13, 1998

[51] Int. Cl.[7] ..... A45F 3/04; A45F 5/00

[52] U.S. Cl. ..... 224/637; 24/590; 224/262; 224/271

[58] Field of Search ..... 224/637, 262, 224/271, 272; 24/590

[56] References Cited

U.S. PATENT DOCUMENTS

| | | | |
|---|---|---|---|
| 4,676,420 | 6/1987 | Sharp | 224/272 |
| 5,201,858 | 4/1993 | Otrusina | 224/272 |
| 5,347,693 | 9/1994 | Otrusina | 24/597 |
| 5,452,497 | 9/1995 | Peng | 224/271 |
| 5,604,958 | 2/1997 | Anscher | 224/272 |
| 5,609,278 | 3/1997 | Fresco | 224/637 |
| 5,620,120 | 4/1997 | Tien | 224/271 |
| 5,622,296 | 4/1997 | Pirhonen et al. | 224/272 |
| 5,729,869 | 3/1998 | Anscher | 224/272 |
| 5,730,342 | 3/1998 | Tien | 224/271 |

*Primary Examiner*—Stephen P. Garbe
*Attorney, Agent, or Firm*—Samuels, Gauthier & Stevens

[57] ABSTRACT

A quick release assembly for releasing a backpack from a waistbelt which comprises a socket and a probe. The socket is adapted to secure the waistbelt and the probe is secured to a backpack. The probe is adapted to matably engage the socket and is configured for forward and backward rotatable movement in the socket. The socket has a recess and means for engaging catch surfaces of the probe. When the angular displacement of the probe from the socket exceeds a predetermined design angle the probe is released from the socket.

19 Claims, 10 Drawing Sheets

BACKPACK QUICK RELEASE SYSTEM

BACKGROUND OF THE INVENTION

1. Field of the Invention

A belt assembly to support and release a backpack.

2. Background and Brief Summary of the Invention

Combat soldiers typically wear a light web-belt to carry often used items such as water-bottles, ammunition, and side-arms. The civilian equivalent to this is the "fanny-pack" popular with day hikers. Both soldiers and hikers, however, have difficulty wearing these light web belts when also wearing a heavy field backpack. Large load bearing backpacks use a substantial waist-belt to distribute the heavy load of the pack from the shoulders out over the wearer's hips. This waist-belt interferes with the web belt if both are worn at the same time. At best, it is inconvenient to move items from the light web belt to the heavy waist-belt or visa versa depending on the moment's need. Combat soldiers and serious mountain climbers have the added concern of being able to quickly drop their large backpacks if suddenly threatened by enemy fire or natural dangers such as avalanches. If essentials such as ammunition and survival gear are on the backpack waist-belt they would be lost just when most needed.

Broadly the invention comprises waist-belts equipped with a socket secured to a belt insert which socket can connect to backpack frames having a mating probe configuration. Alternatively, the waist-belt can be used by itself to carry lighter loads by removing the belt insert. While wearing the waist-belt, the user may shoulder a backpack and easily connect it to his/her waist-belt by inserting the backpack frame's probe into the socket.

A probe socket system for the purposes just described is disclosed in International Application PCT/US97/21188. Although the probe socket system disclosed in that application is suitable for its intended purpose it was discovered that for rigorous conditions a probe socket system was necessary which would increase the stability of the socket/probe assembly while the wearer leans from side to side and to facilitate ease of donning of the backpack while carrying awkward loads.

SUMMARY OF THE INVENTION

The probe socket disclosed herein, with reference to prior art systems, enhances the stability of the probe socket connection when the wearer leans side to side. Rather than having the probe enter the socket from above as in the prior art, the present invention has the probe entering horizontally from the back. This horizontal entry is preferred. Insertion is facilitated by a lip on the bottom of an opening in the socket which lip extends out and catches the probe. As the probe slides down this lip into the interior of the socket, catch tines flex inwardly (toward the wearer's back) and allow the probe to settle downwardly into a cavity in the lower portion of the socket. The prior art design required that prior to insertion the probe be elevated approximately 2" above its final locked position in the socket. In the system of the invention, horn is added on the center line of the socket to guide the probe onto the lip of the socket. The combination of the horn to guide the probe into the socket and the lower probe entry point on the socket enhance the donning of the back pack.

The prior art system uses tines with catch tabs to connect to or lock to the probe. However, under rigorous conditions the mechanical strain on the tines and on the socket during both probe insertion and lateral movement caused occasional failure. With the present invention, the fork of the prior art system is eliminated.

In the system disclosed herein, flexible tines are formed in the socket on both sides of the horn and have catch surfaces which point outwardly (not laterally) from the wearer's back. When the probe is inserted, the catch surfaces flex inwardly toward the wearer's back. This enhances stability by placing the plane of the flex perpendicular to the lateral motion of the back frame probe when the wearer leans side to side. Strain reduction is also achieved because there are no tines which flex toward each other from a common support strut. The present invention effectively reduces by half the deflection needed to allow the catch surfaces on the probe to snap past to achieve a lock during insertion.

When the waist-belt and backpack probe are locked together by the inventive system and the waist-belt is supporting the backpack, the system enhances comfort by allowing the backpack to pivot fore and aft in relation to the waist-belt as the wearer walks or flexes at the torso. To ease balancing the load, the system allows limited (lateral) side-to-side motion.

While being worn, the backpack can be rapidly detached from the waist-belt by either releasing quick release buckles on shoulder straps or by slipping off the backpack's shoulder straps and allowing the pack frame to rotate backwardly in the belt insert's socket. Once the pack frame exceeds a critical backward angle, the probe disengages from the insert and the backpack separates from the waist-belt. The wearer is freed from the backpack, but retains the waist-belt and its attached gear.

DESCRIPTION OF THE PREFERRED EMBODIMENT(S)

In the following description the insert 10, socket 40 and probe 90 each comprise sides which are mirror images of one another.

Figure 1:
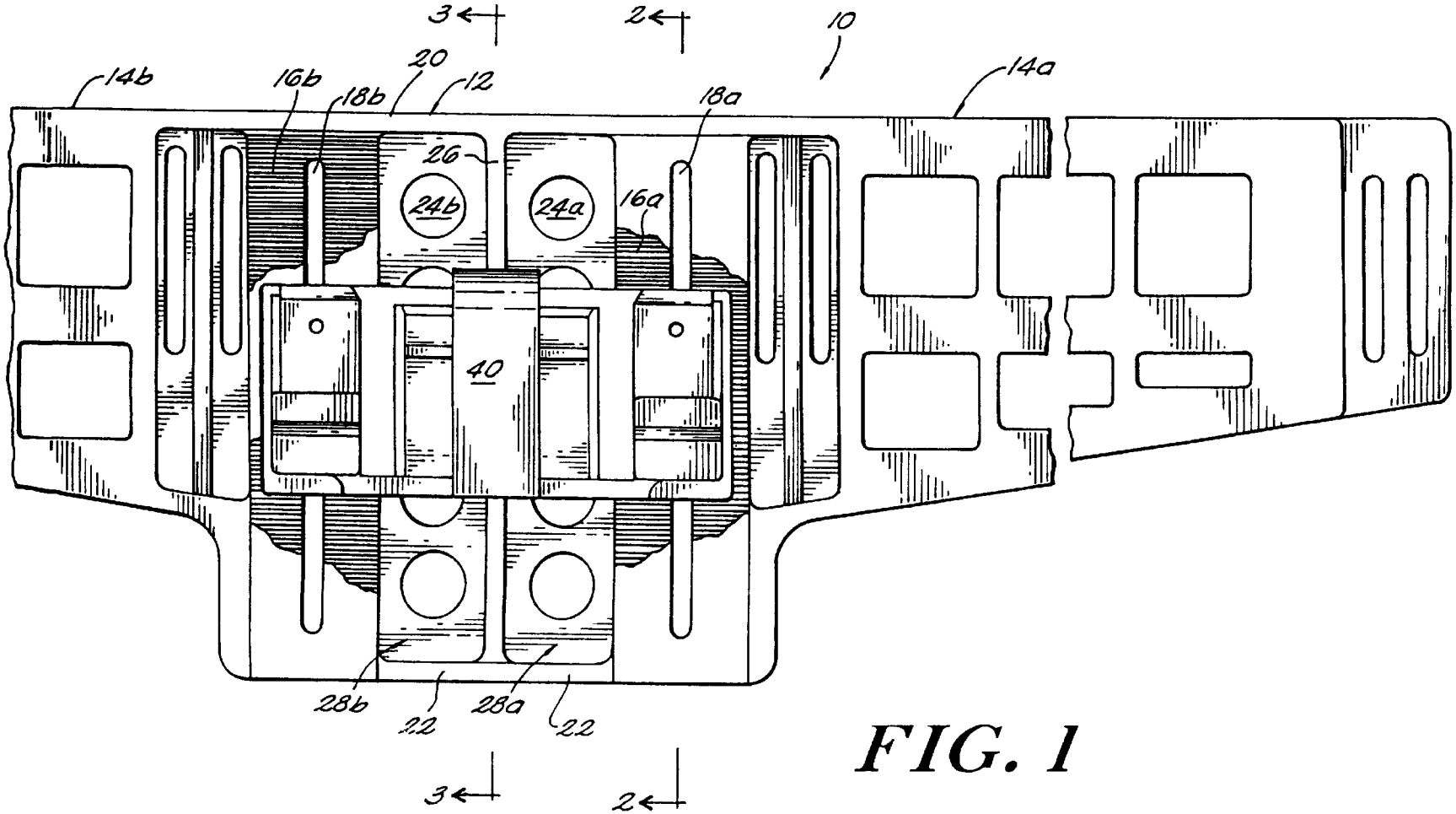
FIG. 1 is a front view of a belt insert/socket embodying the invention.
Figure 2:
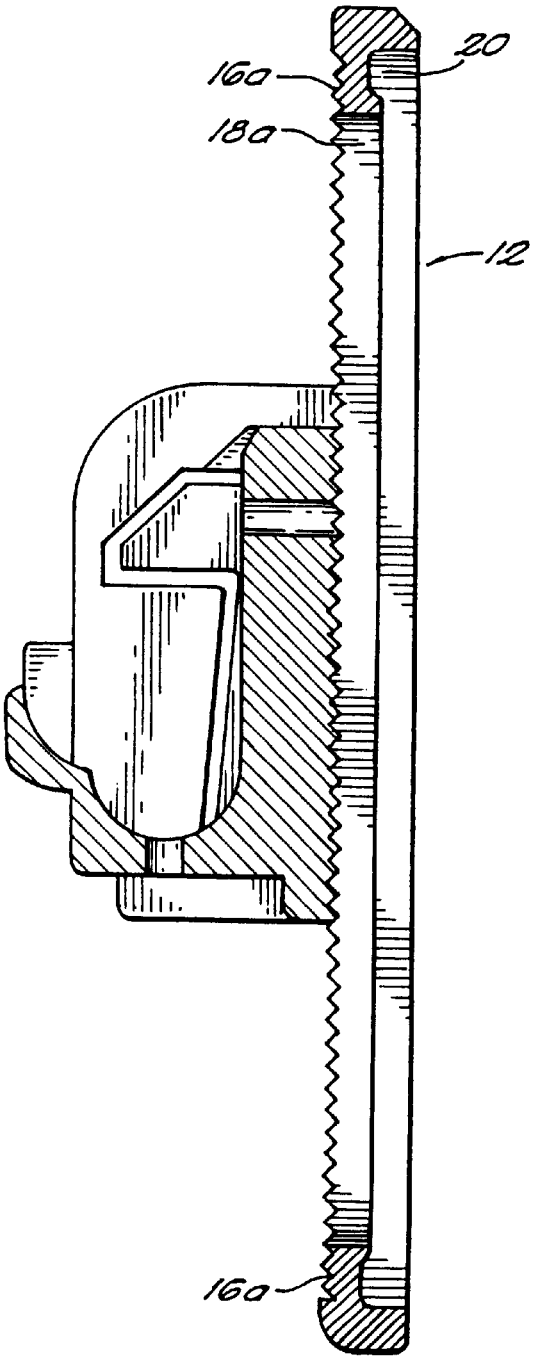
FIG. 2 is a sectional view of FIG. 1 taken along lines 2—2.
Figure 3:
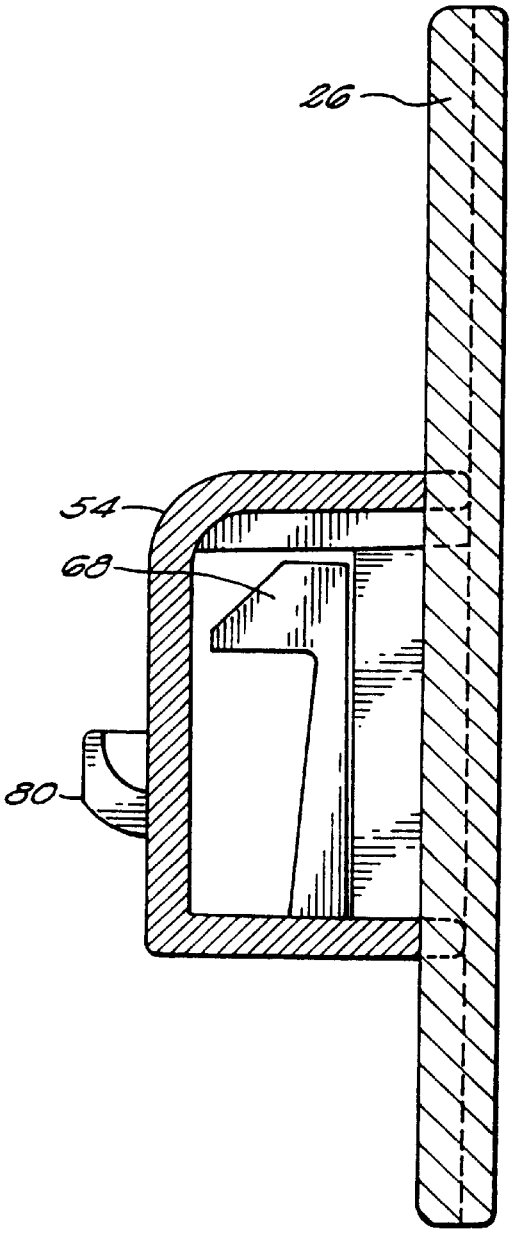
FIG. 3 is a sectional view of FIG. 1 taken along lines 3—3.

Referring to FIGS. 1, 2 and 3, a molded belt insert 10 is shown together with a socket assembly 40. A prior art waist belt to which this insert is secured is shown in the aforementioned PCT publication. The insert 10 comprises a backplate 12 and extending laterally therefrom are wings

14*a* and 14*b*, which wings 14*a* and 14*b* are adapted to be received in fabric sleeves on a waist belt (not shown). The backplate 12 is characterized by a pair of saw-toothed tracks 16*a* and 16*b*, each having a central slot 18*a* and 18*b*. The tracks 16 extend from the backplate 12. Formed at the upper and lower edges of the tracks 16*a* and 16*b* are ribs 20 and 22 respectively which extend from the backplate 12. The backplate 12 also comprises pairs of spaced apart holes 24*a* and 24*b*. A central rib 26 extends from the backplate 12, and the rib 26 together with the opposed ribs 20 and 22 define rectangular recesses 28*a* and 28*b* which receive the socket assembly 40 as will be described.

Figure 4:
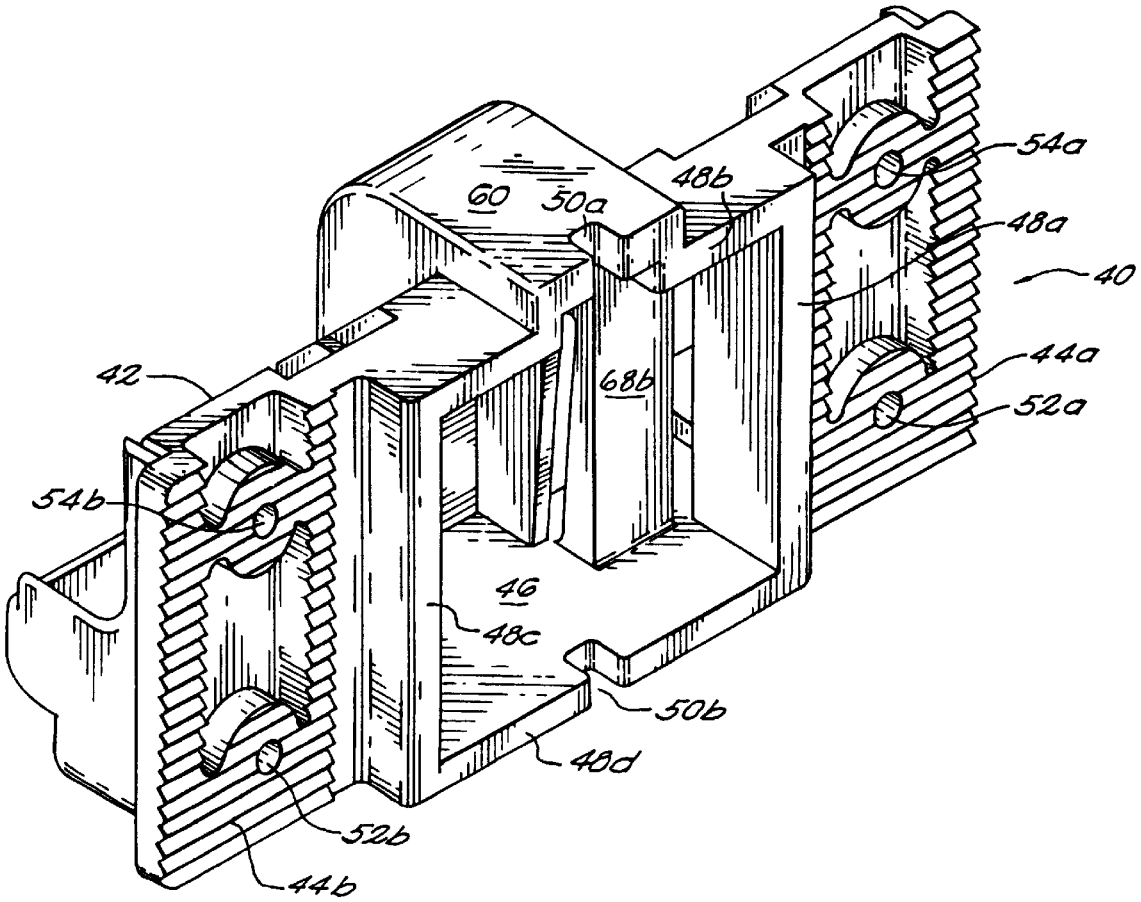
FIG. 4 is a back perspective view of the socket.
Figure 6B:
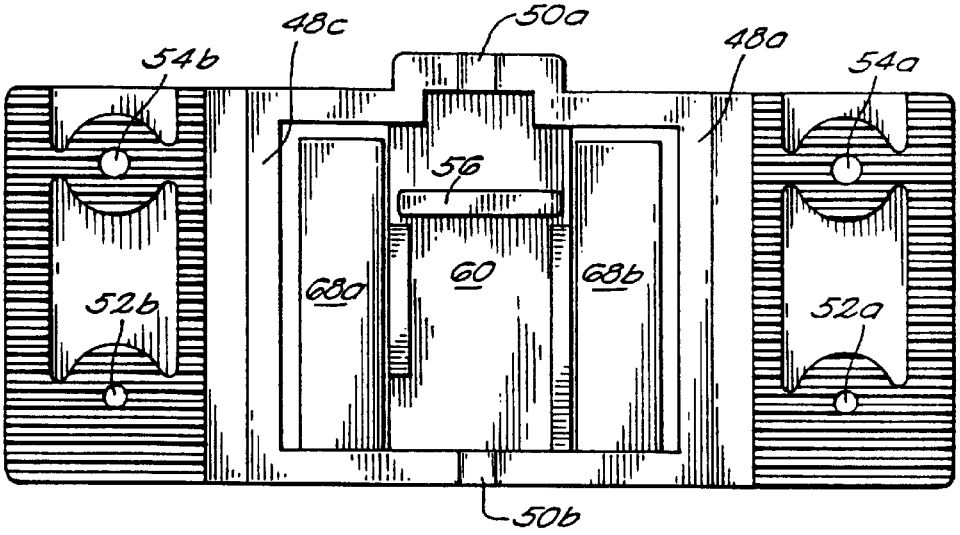
FIG. 6*b* is a back view of the socket.

Referring to FIGS. 4 and 6*b*, the socket assembly 40 has a back plate 42 which is characterized by a pair of saw-toothed tracks 44*a* and 44*b* such that the socket assembly 40 mates and locks with the tracks 16*a* and 16*b* in the insert 10. The backplate 42 is further characterized by an opening 46 whose perimeter is defined by walls 48*a*, 48*b*, 48*c* and 48*d*. The upper and lower walls 48*b* and 48*d* are characterized by notches 50*a* and 50*b* respectively. The backplate 42 has tapped holes 52*a* and 52*b* and through holes 54*a* and 54*b* formed therein. A horizontal plate 56 limits the lateral inward deflection of flexible tines 68*a* and 68*b*, while the walls 48*a* and 48*c* limit the lateral outward deflection of the tines 68*a* and 68*b*. Formed integrally with the top of the backplate 42 is a horn 60.

Referring to FIG. 1, when assembled, the socket 40 is joined by fasteners (not shown) to the insert 10. The fasteners pass through the slots 18*a* and 18*b* in the insert 10 and are received in tapped holes 52*a* and 52*b* in the socket assembly 40. The slots 18 provide the capability of vertical adjustment of the socket assembly 40 on the insert 10. The rib 26 of the insert 10 seats in the notches 50*a* and 50*b* of the socket assembly 40 and the walls 48*a* and 48*b*, and one half of the walls 48*b* and 48*d* of the socket assembly 40 seat in the recesses 28*b* of the insert 10, and the wall 48*c* and the other halves of the walls 48*b* and 48*d* seat in the recess 28*a* of the insert 10.

Figure 5:
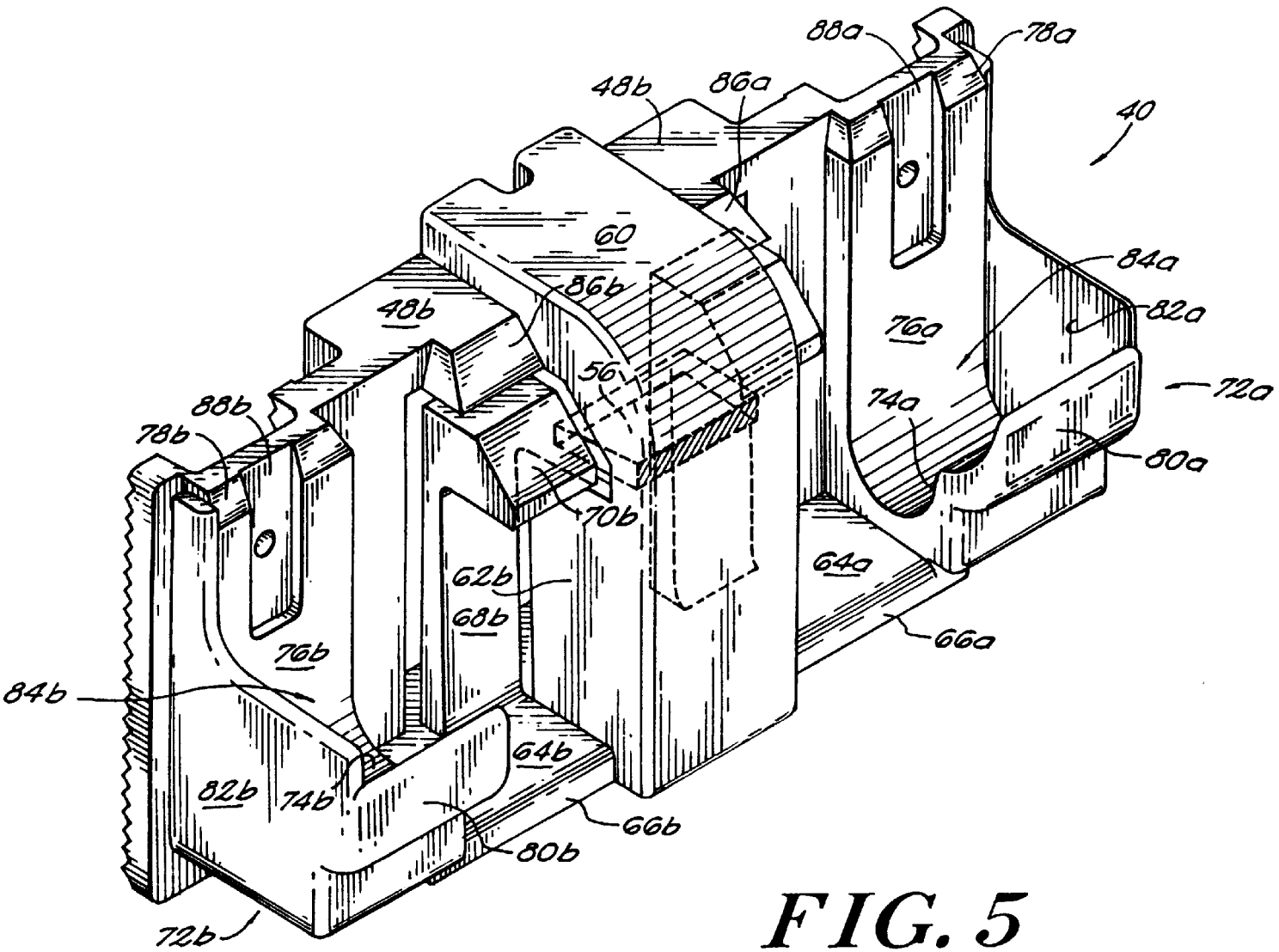
FIG. 5 is a front perspective view of the socket.
Figure 6A:
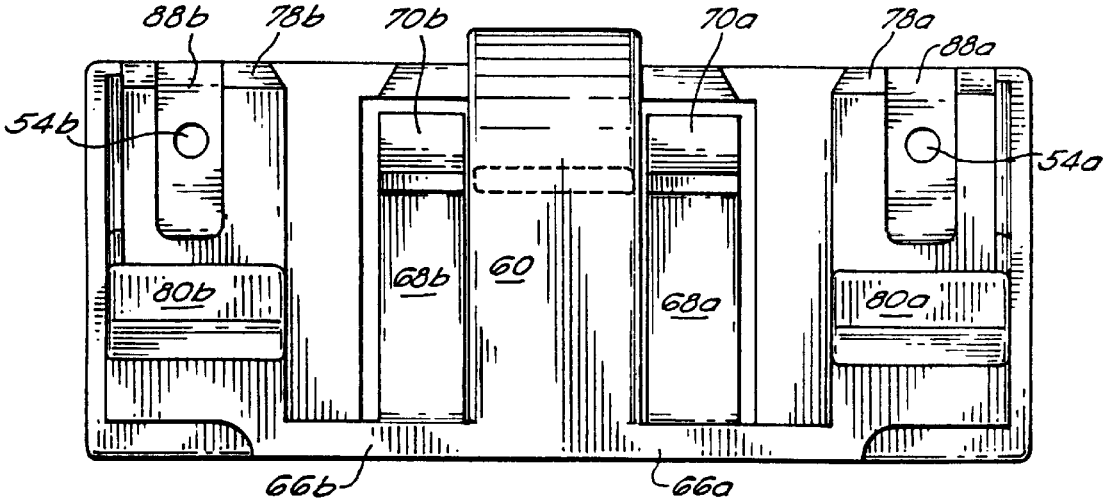
FIG. 6*a* is a front view of the socket.

Referring to FIGS. 5 and 6*a*, the socket 40 comprises the centrally located horn 60 having a convex outer surface. The horn has side walls 62*a* and 62*b* which, as will be described, help stabilize the socket/probe assembly. Floors 64*a* and 64*b* extend laterally from the bottom of the horn 60 and terminate in leading leveling edges 66*a* and 66*b*. Flexible tines 68*a* and 68*b* extend upwardly from the floors 64*a* and 64*b*. As shown more clearly in FIGS. 6*a* and 6*b*, the tines 68*a* and 68*b* are received at least in part in the opening 46. The upper end of each tine 68*a* and 68*b* has a catch tab 70*a* and 70*b*. The socket further comprises two seats shown generally at 72*a* and 72*b*. The seats 72*a* and 72*b* comprise a convex base 74*a* and 74*b*, back walls 76*a* and 76*b*, an upper chamfered surface 78*a* and 78*b*, concave lips 80*a* and 80*b* extending forwardly and outwardly from the seat 74*a* and 74*b*, and side walls 82*a* and 82*b*. The seats 74*a* and 74*b*, backs 76*a* and 76*b*, lips 80*a* and 80*b* and walls 82*a* and 82*b* define cavities 84*a* and 84*b*. The back walls 76*a* and 76*b* are integrally formed with the floors 64*a* and 64*b*, horn 60 and sockets 72*a* and 72*b*. The back wall 48*b* is characterized by leading chamfered surfaces 86*a* and 86*b* which are in substantially the same plane as the surfaces 70*a* and 70*b* of the catch tabs 68*a* and 68*b*. The back walls 76*a* and 76*b* are further characterized by slots 88*a* and 88*b* which will be described with reference to FIG. 10.

Figure 7A:
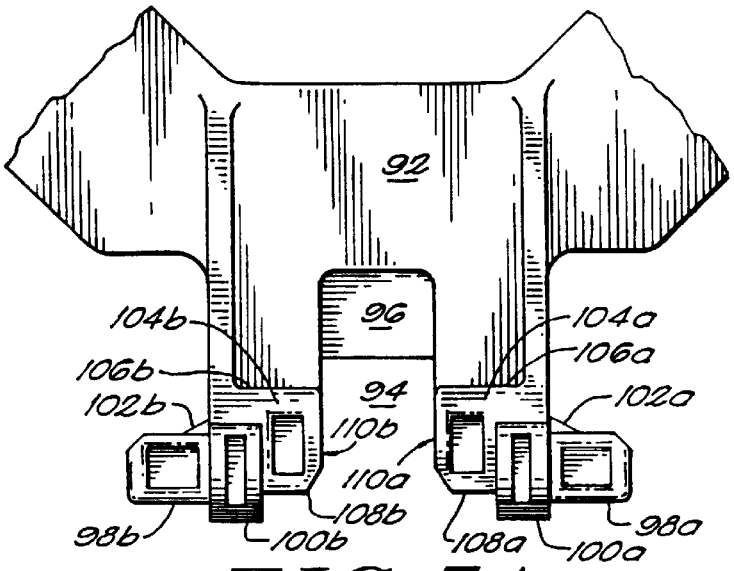
FIG. 7*a* is a front view of a probe embodying the invention.
Figure 7C:
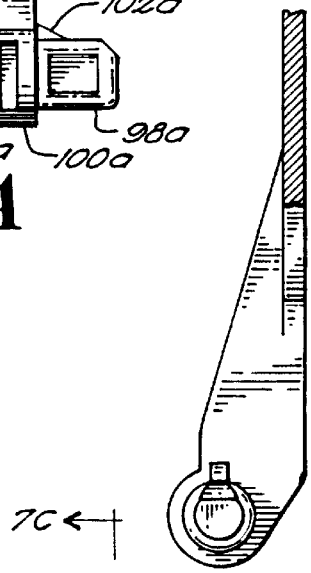
FIG. 7*c* is a right side view of FIG. 7*a;*
Figure 7B:
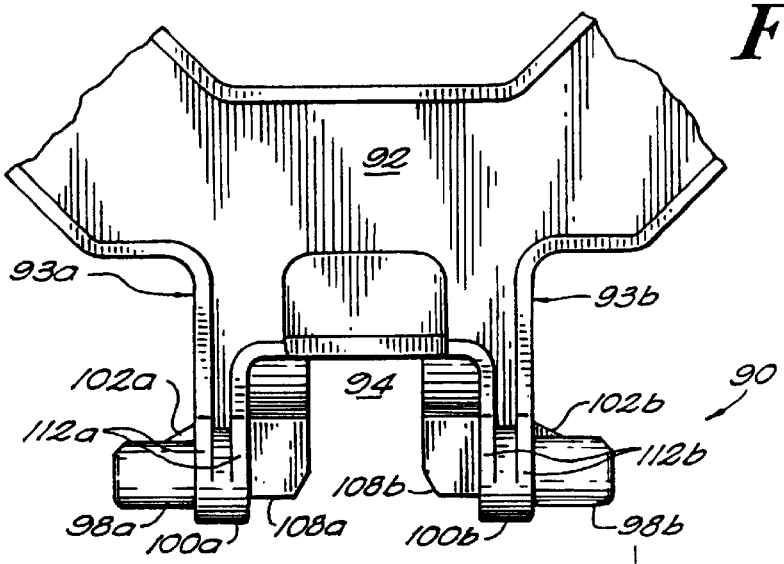
FIG. 7*b* is a back view of FIG. 7*a;*

Referring to FIGS. 7*a*, 7*b* and 7*c*, a probe 90 embodying the invention is shown, which probe 90 depends from a prior art pack frame (not shown) is designed to mate with the socket assembly 40. The probe 90 includes a backplate 92. The probe 90 is substantially U-shaped and define sides 93*a* and 93*b*. The U-shape defines an opening 94 and the plate 92 is characterized by a recess 96. The probe comprises outer cylinders 98*a* and 98*b* which seat in the cavities 84*a* and 84*b* of the socket 40. Extending laterally inward from the outer cylinders 98*a* and 98*b* are second smaller dimensioned struts 100*a* and 100*b* stepped with reference to the cylinders 98*a* and 98*b*. Gussetts 102*a* and 102*b* extend upwardly from the cylinders 98*a* and 98*b* to the struts 100*a* and 100*b*. The struts 100*a* and 100*b* and the gussets 102*a* and 102*b* do not tightly engage the socket 40. Extending inwardly from the struts 100*a* and 100*b* are posts 104*a* and 104*b* which have catch surfaces 106*a* and 106*b*. The posts 104*a* and 104*b* have chamfered surfaces 108*a* and 108*b* to facilitate locating the probe 90 with reference to the horn 60. The posts 106*a* and 106*b* have opposed walls 110*a* and 110*b*. When the probe 90 is inserted into the socket 40 the walls 110*a* and 110*b* abut the side walls 62*a* and 62*b* of the horn 60. This stabilizes the probe 90 in the socket 40. Also, the tines 68*a* and 68*b* are restrained from inward (towards the horn 60) movement by the walls 62*a* and 62*b*. The probe 90 is further characterized by the walls 62*a* and 62*b*. The probe 90 is further characterized by levering surfaces 112*a* and 112*b*.

Figure 8:
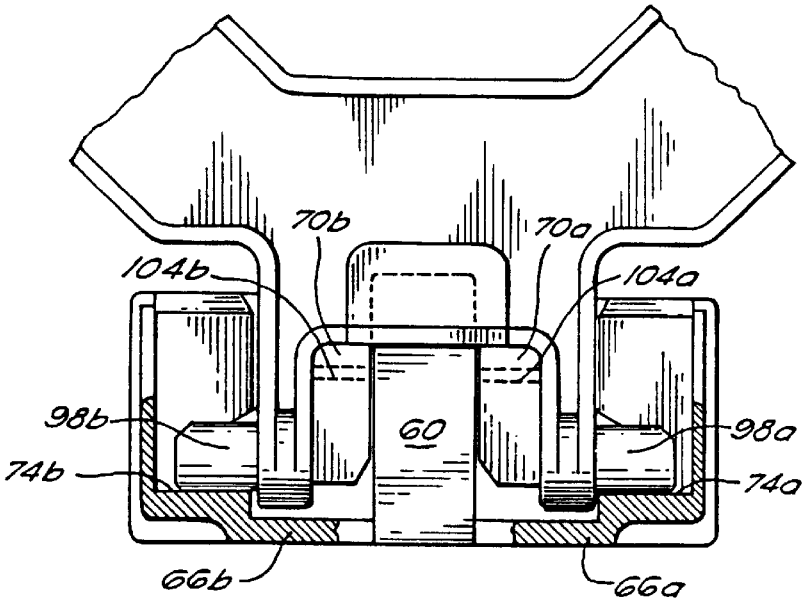
FIG. 8 is a back view of the probe seated in the socket.

FIG. 8 illustrates the probe 90 fully seated in the socket 40.

In the operation of the invention, to secure a pack frame to the socket assembly 40, referring to FIGS. 9*a*, 9*b*, 9*c* and 9*d*, the probe 90 can enter the socket 40 at any angle from about vertical to horizontal. If the probe 90 strikes the socket generally vertically, particularly with a heavy load, the catch tabs 70*a* and 70*b* will deflect rearwardly and allow the probe 90 to descend into the locked position. If the probe 90 enters at an angle between vertical and horizontal, e.g. 15° from vertical, the struts 100 will slide over the surfaces 86/70 and the lips 80 will catch the cylinders 98. The catch surfaces 106 on the probe will slide under the catch tabs 70, guided by the horn 60 and walls 62. The probe 90 will then seat in the socket 40. The cylinders 98 are seated in the cavities 84. The cylinders 98 are seated on the floors 74, FIG. 8. The probe 90 cannot exit vertically because of the catch tabs 70/catch surfaces 106. As will be understood, the wearer adjusts the shoulder straps maintaining the back pack in a generally flat position against the wearer's back.

Figure 9C:
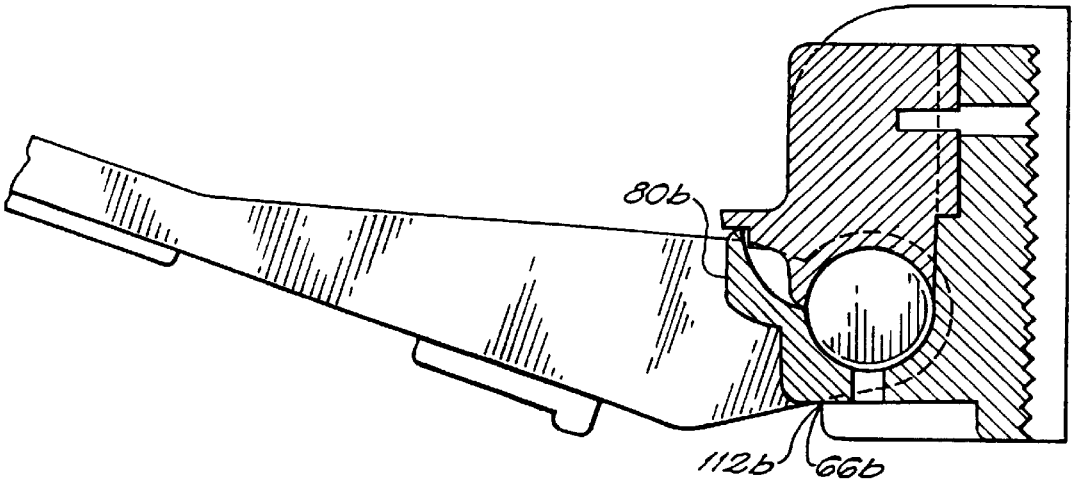
FIGS. 9*a*, 9*b*, 9*c* and 9*d* illustrate the release of the probe from the socket assembly.
Figure 9A:
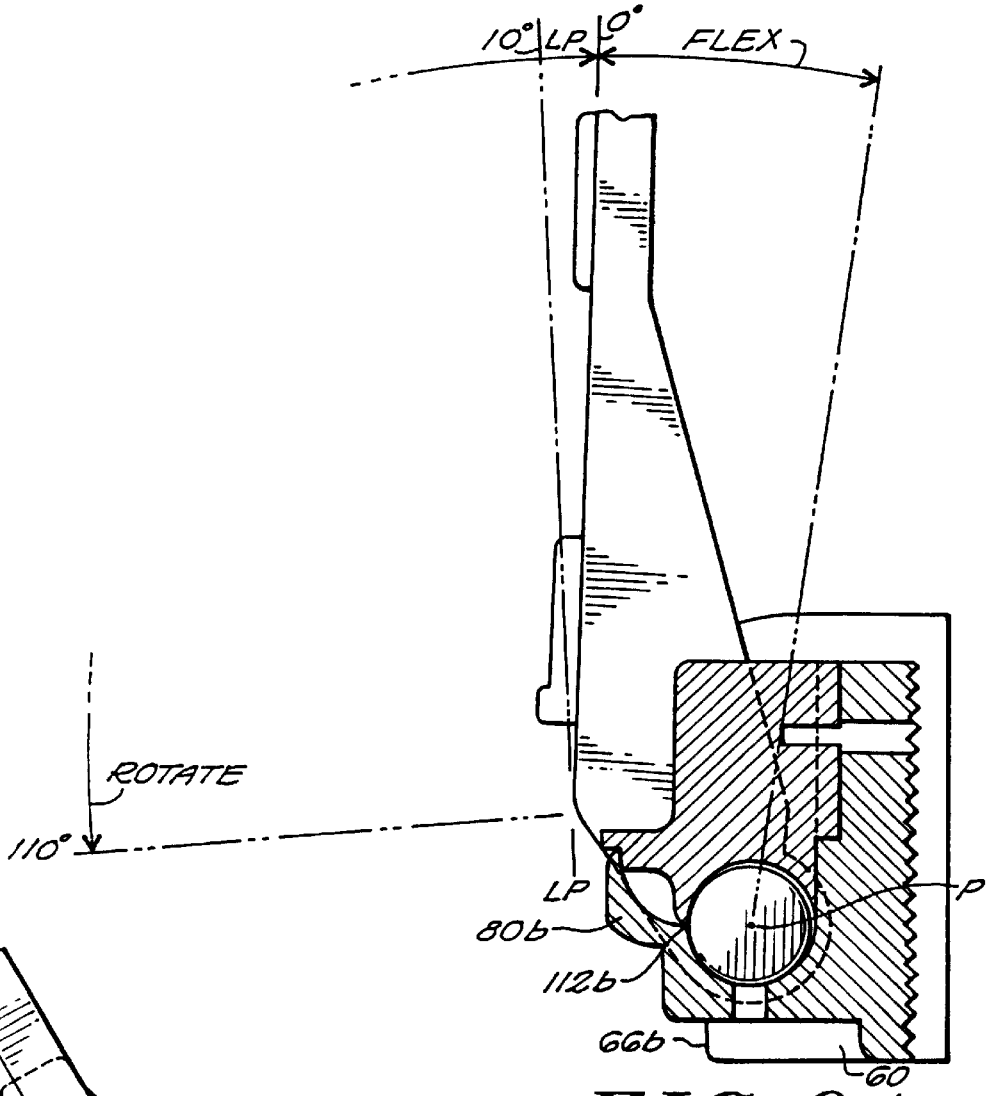

Preferably, the probe 90 enters the socket 40 at any angle between 0 and 90° and the probe 90 rotates forwardly and is fully seated as just described and as shown in FIGS. 8 and 9*a*.

Figure 9B:
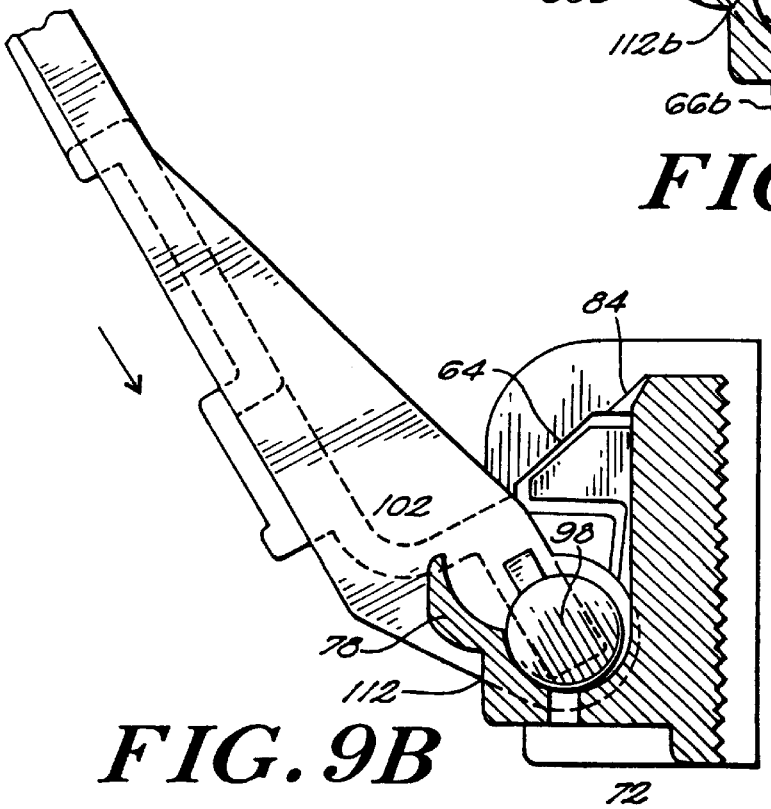
Figure 9D:
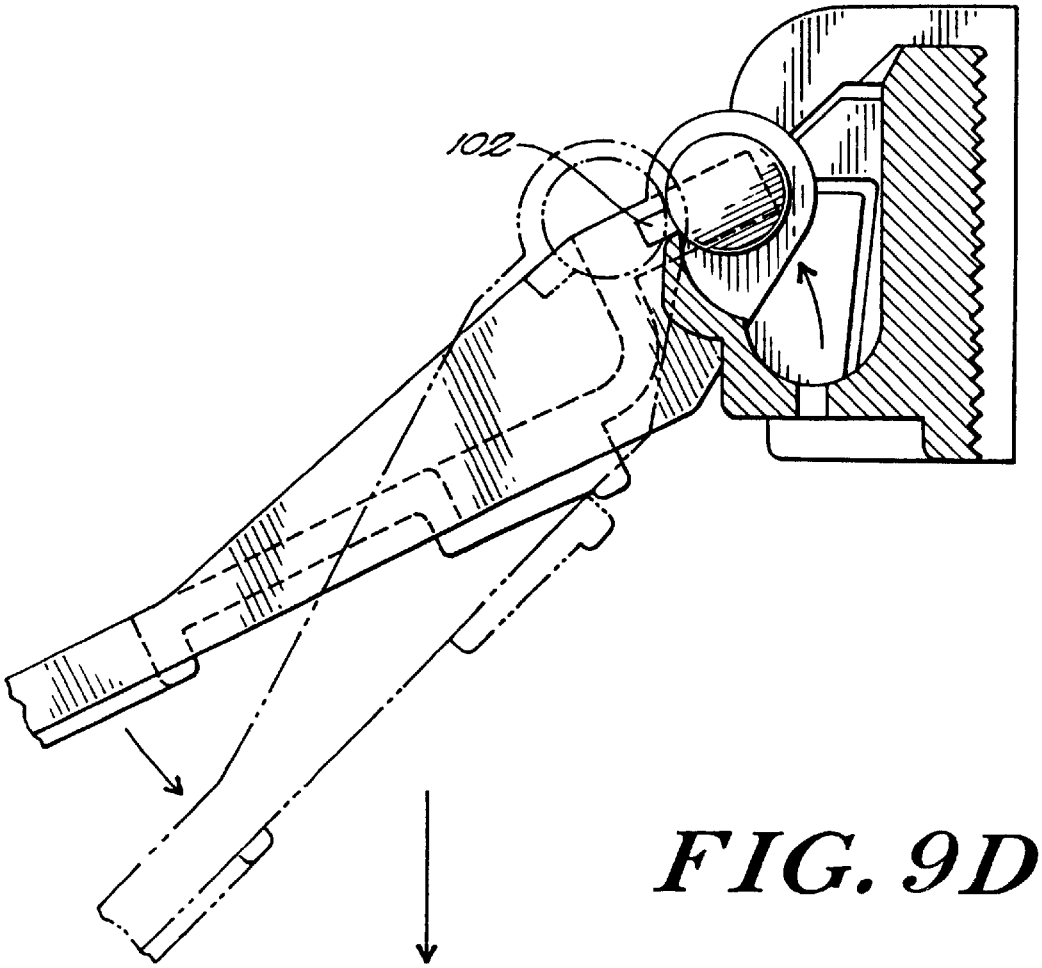

When the probe 90 (pack frame) rotates backwards a minimum of 10 degrees, FIG. 9*b* and 9*c*, the catch surfaces 106 on the probe 90 rotate out from under the catch tabs 70 allowing the probe 90 and socket 40 to separate if pulled apart. When the frame is allowed to freely rotate 110° rearwardly, the levering surfaces 112 engaging the levering edges 66 of the floor 64 force the probe 90 up and out from the socket 40. To protect the probe 90, socket 40 and the wearer from breakage or injury under severe twisting and upward forces, the flexible tines 68*a* and 68*b* deflect enough to allow the two parts to separate without the damage or injury at angles less than 10°.

It has been found that in some circumstances it is more convenient to temporarily attach the frame and the belt insert so that the quick release feature does not function. For example, when transporting/shipping the backpack or when the user's preference is to remove the belt at the same time that the backpack is doffed. Accordingly, in an alternative embodiment of the invention, when the probe is received in the socket, saddle blocks are secured to the socket to hold the probe in place.

Referring to FIG. 9*a* when the probe 90 is seated it freely rotates about pivot axis P. This axis P is offset inwardly (towards the wearer's back) approximately 1 in. from the load bearing plane, LP, of the frame. When the wearer moves the frame can flex fowardly in the FLEX region as the probe 90 rotates at the pivot point, P, in the socket 40. The flexible tines 68 flex fowardly. The movement of the tines 68 is limited by the horizontal plate 58. The net result is the socket 40/probe 90 assembly functions as a leaf spring suspension system to cushion the loads.

Figure 10:
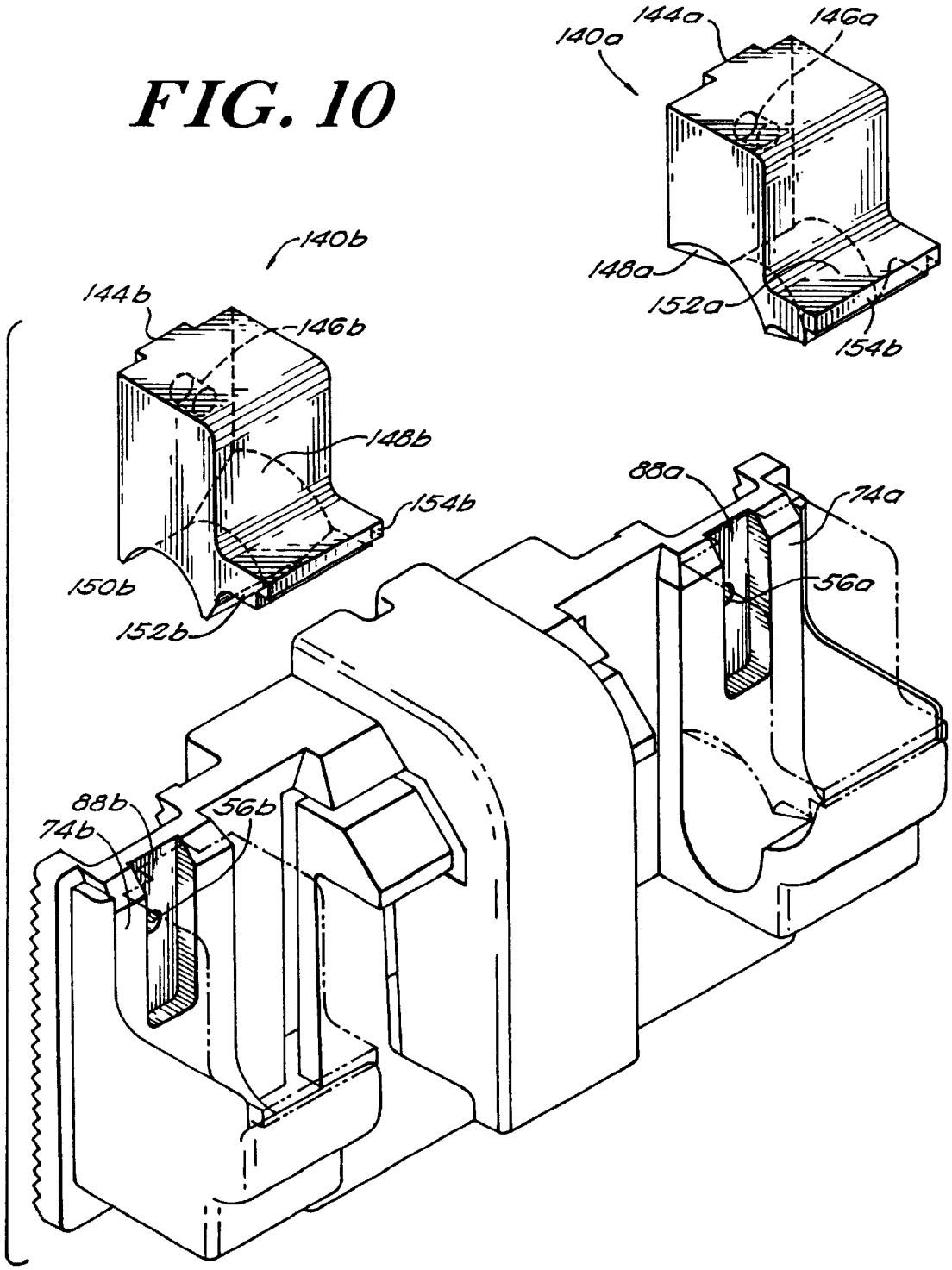
FIG. 10 is a perspective view of an alternative embodiment of the invention.

Referring to FIG. 10, the slots 88*a* and 88*b* are formed in the back walls 76*a* and 76*b* in registration with the through holes 54*a* and 54*b*. Saddle blocks 140*a* and 140*b* have tracks 144*a* and 144*b* which frictionally engage the slots 88*a* and 88*b*. The saddle blocks 140*a* and 140*b* each are characterized by tapped holes 146*a* and 146*b* which are in registration with the holes 54*a* and 54*b* when the blocks 140*a* and 140*b* are fully seated.

Each saddle block 140*a* and 140*b* comprises a first concave surface 148*a* and 148*b* which covers 98*a* and 98*b* and a second concave surface 150*a* and 150*b* which cover gussets 102*a* and 102*b*. Lips 152*a* and 152*b* having flanges 154*a* and 154*b* are received in the seat 72*a* and 72*b*. The saddle blocks are shown inserted in dotted lines Threaded fasteners or capture screws (not shown) pass through the holes 54 and engage the tapped holes 146 to secure the saddle blocks in position. As shown, when installed the saddle blocks fully enclose the bearing surfaces of the probe/socket assembly to protect them from dust/dirt contamination and they restrain the probe from moving upwardly and out of the socket. With the saddle blocks installed, the probe can freely rotate in the socket, thus retaining the spring action and the belt articulation features of the system. To enhance strength and stability the inside faces of the saddle blocks contact the probe sides when the frame is moved side to side (laterally). Webbed restraining straps (not shown) can also be attached from the belt insert wings 14*a* and 14*b* to the frame to keep the frame from rotating rearwardly to the point where the levering surfaces engage and try to force the probe upwardly.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A quick release assembly for releasing a backpack from a waistbelt which comprises:

a socket adapted to be secured to the waistbelt;

a probe adapted to be secured to the backpack, the probe characterized by catch surfaces, the probe having at least one arm to be received in and to seat the probe in the socket for mating engagement with the socket and for forward and backward rotatable movement in the socket between an engaged position and a released position; and the socket having a recess in which the arm of the probe is received and means for engaging the catch surfaces of the probe whereby when the angular displacement of the probe from the socket exceeds a predetermined design angle the probe is released from the socket.

2. The assembly of claim 1 wherein the base of the recess is concave and the leading edge of the probe is convex.

3. The assembly of claim 2 wherein the means for engaging the catch surfaces of the probe comprises:

catch tabs secured in the recess.

4. The assembly of claim 1 wherein the socket comprises a pair of cavities, the cavities having a leading edge.

5. The assembly of claim 4 wherein the cavities are concave.

6. The assembly of claim 4 wherein the socket comprises:

means to guide the probe into the socket.

7. The assembly of claim 6 wherein said means to guide comprises lips formed on the leading edge of the cavities.

8. The assembly of claim 7 wherein the socket comprises a horn spaced between the cavities.

9. The assembly of claim 4 wherein the means for engaging the catch surfaces comprises catch tabs secured in the socket and adjacent the cavities.

10. The assembly of claim 4 wherein the probe is U-shaped and defines opposed arms, the arms of the probe adapted to be received on either side of the horn.

11. The assembly of claim 10 wherein the arms are characterized by cylinders extending laterally outward from the arms, the cylinders are adapted to be received in the concave cavities.

12. The assembly of claim 11 wherein gussets extend from the cylinders to the arms.

13. The assembly of claim 11 wherein the radii of the convex and concave surfaces are matched and the surfaces of the catch tabs and the catch surfaces of the probe insert are matched to facilitate the quick release of the backpack from the socket assembly.

14. The assembly of claim 7 wherein the catch tabs and the lips define an opening therein through which opening passes the probe in a non-vertical direction, the probe adapted to rotate upwardly in the socket whereby the catch tabs engage the catch surfaces and the catch tabs prevent a vertical upward movement of the probe.

15. The assembly of claim 1 which comprises:

means to prevent the release of the probe from the socket.

16. The assembly of claim 15 wherein the means to prevent comprises a pair of saddle blocks secured in the cavities of the socket.

17. The assembly of claim 15 wherein the saddle blocks comprise tracks that frictionally engage the back walls of the socket.

18. The assembly of claim 17 wherein the saddle blocks comprise concave surfaces that engage the opposed arms of the probe.

19. The assembly of claim 18 wherein the means for securing the saddlebacks comprises rearwardly positioned tapped holes, said tapped holes adapted to receive threaded screws that pass through the back of the socket.

* * * * *